United States Patent [19]

Driscoll

[11] 4,355,293

[45] Oct. 19, 1982

[54] ELECTRICAL RESISTANCE APPARATUS HAVING INTEGRAL SHORTING PROTECTION

[75] Inventor: Barry J. Driscoll, Newport News, Va.

[73] Assignee: The Bendix Corporation, Southfield, Mich.

[21] Appl. No.: 281,804

[22] Filed: Jul. 9, 1981

Related U.S. Application Data

[63] Continuation of Ser. No. 86,911, Oct. 22, 1979, abandoned.

[51] Int. Cl.[3] ..... H01C 10/00

[52] U.S. Cl. ..... 338/184; 123/494; 338/162; 338/183; 338/211; 338/309

[58] Field of Search ..... 338/210–212, 338/307–309, 262, 292, 125, 128, 142, 160, 162, 167, 170, 171, 176, 183, 188; 123/494; 427/101–103, 123–126

[56] References Cited

U.S. PATENT DOCUMENTS

| | | | |
|---|---|---|---|
| 3,045,200 | 7/1962 | Hines et al. | 338/174 |
| 3,061,807 | 10/1962 | Hollander et al. | 338/176 |
| 3,457,537 | 7/1969 | Hines | 338/162 |
| 4,012,710 | 3/1977 | Ward et al. | 338/128 |
| 4,060,788 | 11/1977 | Numata et al. | 338/128 |
| 4,139,831 | 2/1979 | Ortlieb et al. | 338/128 |
| 4,280,465 | 7/1981 | Staerzl | 123/494 |
| 4,308,838 | 1/1982 | Nakano et al. | 123/494 |

*Primary Examiner*—C. L. Albritton

*Attorney, Agent, or Firm*—Russel C. Wells; William A. Marvin

[57] ABSTRACT

An electrical resistance apparatus adapted for the measurement of the position of the throttle blade of an internal combustion engine is disclosed. The apparatus includes a generally annular housing which has an inside surface that supports a flexible resistive element. The resistive element comprises a flexible web on which two parallel resistive tracks have been overlaid. A generally cylindrical rotor mounts within the housing and electrically couples the two tracks by means of a U-shaped conductive wiper that bridges the separation between the resistive tracks. The rotor is mechanically connected to the throttle blade of the internal combustion engine and rotates therewith. By applying the leads of a power supply to one resistive track and reading a voltage signal from the other resistive track, a potentiometric signal related to the position of the throttle blade is developed. Integral with the resistive track developing the position signal is a protection resistor providing shorting protection in case of the misconnection of the power and signal terminals.

11 Claims, 10 Drawing Figures

+V
V OUT

ELECTRICAL RESISTANCE APPARATUS HAVING INTEGRAL SHORTING PROTECTION

This is a continuation of application Ser. No. 86,911, filed Oct. 22, 1979, now abandoned.

The invention pertains generally to electrical resistive apparatus and is more particularly directed to a resistive apparatus having a flexible resistive element with integral shorting protection.

In many instances, the electronic control of the air/fuel ratio of an internal combustion engine requires the sensing of the position of the throttle blade. Useful information such as the air flow can be established from knowing the relative angle of the throttle blade with respect to a reference and, moreover, an acceleration enrichment signal can be developed from the rate of change of that angle. Special condition calibrations of the electronics further necessitate the sensing of the throttle blade at its extreme positions when it is either fully closed or at a wide-open position.

An advantageous type of sensor for this application has been devised whereby a resistive element is utilized to generate a potentiometric representation of the throttle position. The position signal is generated as a fractional part of the potential applied to the resistive element and results from the positioning of a mechanical wiper moveable in concert with the throttle blade. The wiper slides along the resistive element to produce the signal by electrically conducting current only through that portion of the resistive element between it and the potential source.

An improvement on this structure uses a resistive element that is flexible and adapted for mounting against an arcuate surface of a sensor housing. The resistive element generally comprises a multi-layered structure where a flexible backing web is overcoated with a conductive terminal layer and a resistive material layer in a pattern for connection as a potentiometer. The patterns are produced by modern masking and screening techniques which permit many identical elements to be manufactured at the same time.

This method permits the facile assembly of the sensor from a separately molded sensor housing and the mass-produced flexible resistive elements. Therefore, a sensor with a high reliability of operation and long life is produced which is additionally very rugged. A resistance element of this type in a sensor also provides the infinite resolution for the position signal necessary for accurate control of the internal combustion engine.

To produce an even more desirable sensor, the resistive element pattern can be configured as two parallel tracks where one track is a primary resistive element forming the potentiometer resistor and the other track is a position signal pick-up for determining the operation point for the sensor. The first track is patterned by bridging two conductive terminal pads on the flexible web with a resistive layer. This resistive layer becomes the potentiometer resistor when the terminal pads are connected between the leads to a source of voltage. The second, or signal, track comprises a conductive layer on the web with a thin overlayer of resistive material to prevent wear. A U-shaped conductive wiper on the rotor of the device electrically couples these two tracks together so that a potentiometric signal can be taken off the second track.

This configuration is highly desirable because it eliminates the need for a commutating device to transfer the signal from a rotating member. The second track remains stationary, as does the first, and the terminals are easily connected by fixed leads for transmitting the position signal to the electronic engine controller.

One problem with this otherwise advantageous sensor structure is that it is susceptible to damage from misconnections. Since the second track is essentially a thin conductor of only a few mils of thickness, its current-carrying capability is limited. When properly connected, the second track is current-limited by some portion of the primary or potentiometer resistance. If, however, the sensor is misconnected by applying a potential or a power supply to the signal lead, the full current available will be drawn through the unprotected track when the sensor is in an open throttle or closed throttle position. The excess current will cause a catastrophic failure of this unit as the thin conductive layer is destroyed and becomes an open circuit. Therefore, it would be highly desirable to provide protection against such shorting of the device if a misconnection occurs.

Accordingly, as a primary object, the invention provides integral shorting protection for a flexible resistive element of an electrical resistance apparatus. Preferably, but not necessarily, the electrical resistance apparatus is a position sensor for generating a potentiometric indication of the angle of the throttle blade of an internal combustion engine.

The resistive element comprises a flexible backing web on which there is overlaid first and second resistive tracks generally parallel to each other. The first track is formed by bridging two spaced electrical terminal pads with a first resistive layer. The first resistive layer forms a potentiometer resistor which is infinitely variable by slideably engaging its surface with a conductive wiper member.

The second track is formed by a conductive layer spaced apart from an electrical signal terminal pad. The conductive layer of the second track is overlaid with a layer of resistive material which bridges the gap between the signal terminal pad and the conductive layer. The resistive material in the space between the signal terminal and the conductive layer forms an integral protection resistor to prevent the conductive layer from accidentally being short-circuited. Preferably, the protection resistor is minimized according to the potential to be applied to the sensor and the current-carrying capability of the conductive layer of the second track.

These and other objects, features and aspects of the invention will be more fully understood and better described if a reading of the detailed disclosure is undertaken in conjunction with the appended drawings wherein.

Figures 1, 1A, 1B:
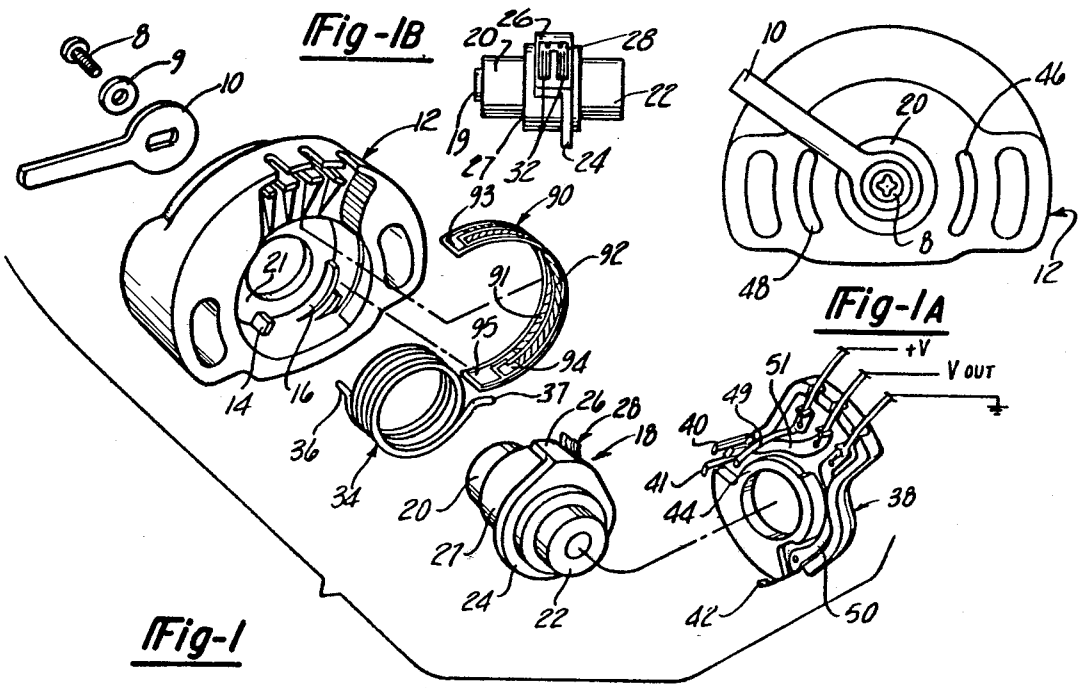
FIG. 1 is an exploded assembly view in perspective of a throttle position sensor utilizing a flexible resistive element.
FIG. 1A is an end view of the throttle position sensor illustrated in FIG. 1.
FIG. 1B is a side view of the rotor of the throttle position sensor illustrated in FIG. 1.

A throttle position sensor including a flexible resistive element constructed in accordance with the invention is illustrated in FIG. 1. The sensor shown is particularly adapted for measuring the position of a throttle blade of an internal combustion engine and for providing a potentiometric output indication thereof.

The throttle position sensor includes a Sensor Housing 12 which is generally annular in shape which mounts a substantially cylindrical Rotor 18 within. The Rotor 18 is journaled on an Outer Rotor Spindle 20 and an Inner Rotor Spindle 22. The Outer Rotor Spindle 20 mounts through an aperture in an integrally formed Bottom 21 of the rotor housing, and the Inner Rotor Spindle 22 is supported in its rotation by a Mounting Rim 44 in an End Cap 38 which covers the front of the Sensor Housing 12.

Each spindle is an extension of a Main Motor Spool 27 which connects the two members. Radially formed on the rotor spool is Flange 24 which supports an Extension Plate 26 providing a surface spaced away but generally parallel to the surface of the spool.

The extension plate has affixed thereto by pins or other suitable means a generally U-shaped Wiper Member 28 having parallel extending legs which contain a plurality of flexible metal Fingers 32. The Wiper Member 28 is conductive and is sized to bridge the space between two resistive tracks on a flexible element to be described more fully hereinafter. The wiper member, therefore, provides a circuit means for the conduction of current from one track to the other.

A Coiled Spring 34 mounts in the space between the extension plate and the spool of the Rotor 18. A parallel Tang 36 of the spring, generally parallel with the longitudinal axis of the spring, is assembled to one side of a Spring Stop Tab 14 in the sensor housing. The Spring 34 also includes a perpendicular Tang 37, general perpendicular to the longitudinal axis of the spring, which is positioned to overlap one side of the Extension Plate 26.

When the Rotor 18 is assembled in its journals between the Bottom 21 and End Cap 38, the Spring 34 will resiliently bias it against a Rotor Limit Tab 16 because of the Tang 28. As the rotor turns counterclockwise, in the sense seen in the drawing, the location of the Tangs 28 and 36 against the stops will cause the Spring 34 to wind up and produce a return force against the Extension Plate 26. This will cause the rotor to return to a neutral position against the Tab 16 when the force causing rotation ceases.

A Lever Member 10 is provided for mechanical linkage to the throttle blade of the internal combustion engine. A mechanical connection to the Rotor 18 is made by securing the head of the Lever Member 10 over a key formed in the Outer Spindle 20 by means of a Washer 9 and Machine Bolt 8. As is better seen in FIG. 1A, the Lever 10 rests against an upstanding Shank 48 when the throttle blade is closed and is rotable to a position against a Shank 46 when the throttle is wide open.

Cemented to an arcuate inner wall of the Sensor Housing 12 is a Resistive Element 90 including two generally parallel tracks which slideably interface with the legs of the Wiper Member 28. The wiper member electrically couples the two tracks together by bridging their separation with a conductive path. The Fingers 32 on each leg of the wiper member are bent at the tips to maintain a sharp sliding contact with the tracks. Because the Resistive Element 90 is flexible, it is easily mounted and forms a flat strip-like potentiometer against the arcuate wall section of the sensor housing.

In the embodiment illustrated, the First Resistive Track 91 includes two Terminal Pads 93,95 which slideably interface with Flexible Prongs 41, 42 of the End Cap 38. The first resistive track is connected between a positive supply of voltage (+V) and ground via Terminal Connectors 49, 50 to become a potentiometer resistor. The Second Resistive Track 92 is electrically coupled to a signal terminal Vout by a Flexible Prong 40 of Terminal Connector 51. The resiliency of the Prongs 40, 41, 42 assures a positive connection to the resistive element when the End Cap 38 is assembled onto the sensor housing.

In operation, as the throttle blade of the internal combustion engine is opened or closed, the mechanical linkage to the Lever Member 10 moves the rotor and, along with it, the Wiper Member 28 along the primary or first resistive track. The amount of current that the first resistive track conducts is determined by the position of the wiper member and thus the distance between the wiper contact point and the positive terminal of the power supply. Electrical current is carried through the wiper to the second track and thereafter picked up by the signal terminal connector and transmitted as the signal Vout to be a potentiometric measurement of the throttle position.

Figure 2:
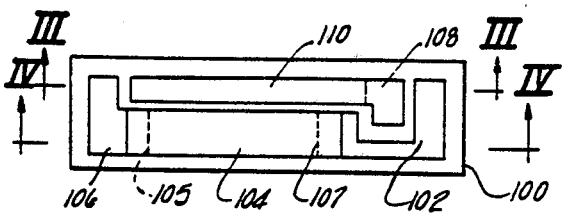
FIG. 2 is a plan view of a prior art flexible resistive element for the throttle position sensor illustrated in FIG. 1.
Figure 3:
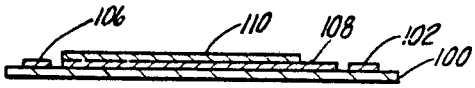
FIG. 3 is a cross-sectional side view of the resistive element illustrated in FIG. 2, taken along the line III—III of that figure.
Figure 4:
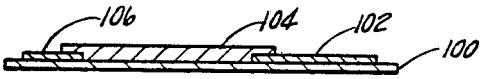
FIG. 4 is a cross-sectional side view of the resistive element illustrated in FIG. 2, taken along line IV—IV of that figure.

The prior art Flexible Resistive Element 90 is illustrated in and will be more fully described with respect to FIGS. 2, 3 and 4. The thickness of the layers illustrated in these figures has been greatly exaggerated for clarity. The resistive element comprises a Flexible Backing Web 100 on which there have been screened the patterns for the first and second resistive tracks. The Web 100 is a flexible, synthetic material chosen for its wear characteristics and can be obtained from the DuPont Corporation under the Trademark KAPTON. Preferably, webs of approximately 0.005" in thickness are utilized to advantage.

The first track comprises conductive Terminal Pads 102 and 106, which are separated from each other on the flexible web by a Resistive Layer 104. The Resistive Layer 104 forms a potentiometric resistance which is infinitely variable along the length of the layer between the Ends 105, 107 of the Terminal Pads 106 and 102, respectively.

The second resistive track comprises an L-shaped Conductive Terminal 108 which extends the length of a Resistive Overlayer 110. For the resistive apparatus to function as a potentiometer, only the Conductive Layer 108 is necessary to conduct current from the wiper member, but the Resistive Overlayer 110 is much more durable. This Overlayer 110 protects the Conductive Terminal 108 from the scraping action of the wiper member while not adding significantly to the resistance of the terminal. This is because current is readily conducted through the wiper member and the thickness of the overlayer rather than having to travel its length because of the layer of conductive material underneath.

Preferably, the terminal pads and conductive terminals are formed by screening a conductive ink onto a KAPTON substratum. A conductive ink of fine-mesh silver particles in an epoxy binder is commercially available from the Methode Development Corporation of Chicago, Ill. The conductive strata are generally between ½ and ¾ mil in thickness when manufactured in this manner.

Similarly, the resistive layers are screened onto the KAPTON substratum by using a resistive ink. The resistive ink preferably comprises a suspension of carbon particles immersed in an epoxy binder. A commercially available resistive ink for this purpose is obtainable from the Methode Development Corporation. The approximate thickness of the resistive layers is similarly between ½ and ¾ of a mil when formed in this manner.

Figure 5:
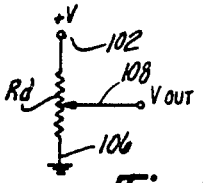
FIG. 5 is a detailed electrical schematic diagram of the resistive element illustrated in FIG. 2.

An electrical schematic of the Resistive Element 90 is illustrated in FIG. 5, wherein the wiper member electrically connects the two tracks and the potentiometric output Vout is provided from Terminal 108. It is evident that if the positive voltage lead of the power supply +V were connected mistakenly to either Terminal 108 or 106, then the Terminal 108 would carry the full current available from the supply when the position sensor was in a closed or a wide-open throttle position. This full current would be shorted to ground, thereby overloading the thin conductive layer of the terminal and destroying it.

A resistive element constructed in accordance with the invention will now be described with reference to FIGS. 6 and 7. The resistive element having integral shorting protection illustrated in FIG. 6 is essentially similar to the resistive element shown in FIG. 2, except that the conductive terminal of the second track has been broken into two Terminal Pads 124, 126 to permit a Protection Resistor 122 to be integrally formed with Resistive Overlayer 120.

The protection resistor is sized by initially calculating the width and thickness of the element and multiplying this cross-sectional area by the conductivity of the material used. The resistor may be trimmed to any number of desired values by adjusting the length of the gap across which the current must pass. The Protection Resistor 122 is sized so that the resistance will be minimized for the potential utilized but still form an effective current-limiting barrier to the short-circuiting of the Terminal 124.

The protection resistor is preferably located between the end of the travel of the wiper on the Primary Resistor 116 and the Signal Terminal 124. This permits the functioning of the resistive element in the sensor, as heretofore described, but additionally provides the integral protection resistor as an advantageous feature. The configuration disclosed is generally facile, since the manufacturing of the resistive element occurs in an identical manner to the method used to manufacture the resistive element described in FIG. 2. The mask or pattern for screening the conductive layer of the second track can be composed with a mask of the correct size separating Conductive Parts 120 and 124. The mask for the resistive material overlaying the conductive portion remains unchanged.

Figure 6:
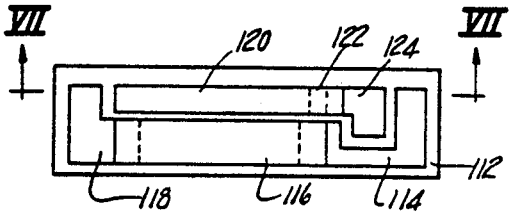
FIG. 6 is a plan view of an improved flexible resistive element constructed in accordance with the invention.
Figure 7:
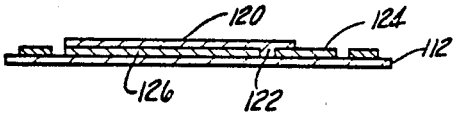
FIG. 7 is a cross-sectional side view of the flexible resistive element illustrated in FIG. 6.
Figure 8:
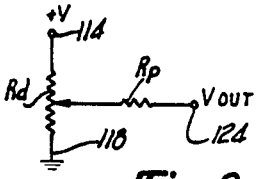
FIG. 8 is a detailed electrical schematic diagram of the resistive element illustrated in FIG. 6.

An electrical schematic of the resistive element shown in FIG. 6 is shown in FIG. 8, wherein a protection resistor $R_p$ provides current limiting for a divider resistor $R_d$ which generates the signal Vout via Terminal 124.

While the preferred embodiment of the invention has been illustrated, it will be obvious to those skilled in the art that various modifications and changes may be made thereto without departing from the spirit and scope of the invention, as will be hereinafter defined in the following claims wherein:

What is claimed as an exclusive right is:

1. A flexible resistive element adapted for connection as a potentiometer comprising:

a flexible web;

a first track overlaid on said web and forming a potentiometer resistor, said first track having a first resistive layer between two limits on said track, a first conductive terminal pad and a second conductive terminal pad each respectively electrically connected to said track outwardly of said two limits;

a second track overlaid on said web and forming a signal terminal, said second track displaced from and substantially parallel to said first resistive layer, said second track including a third conductive terminal pad at one end thereof outwardly of one of said limits; and resistive means integral with said second track and between said third conductive terminal and said one limit comprising a protection resistor thereby providing integral shorting protection between said third conductive terminal and at least one of said first and second conductive terminals.

2. A flexible resistive element as defined in claim 1 wherein:

said second track is overlaid with a resistive layer integral with resistive means.

3. A flexible resistive element as defined in claim 2 wherein:

said first resistive layer is infinitely variable and adapted to be slideably contacted with a wiper member between said two limits and;

said protection resistor is electrically fixed and being electrically located in circuit between said third terminal and one of said limits.

4. A throttle position sensor for generating a signal indicating the position of a throttle relative to a known position, said sensor comprising:

housing means;

first means rotatably disposed in said housing, said first means adapted to be connected to the throttle and operative to rotate in response to movement of the throttle;

resistance means fixedly attached to an internal surface of said housing means;

contact means operatively connected to said first means; and in electrical contact with said resistance means for providing a resistance value referenced to one end of said resistance means indicative of the position of the throttle;

electrical connector means electrically connected to the opposite ends of said resistance means and to said contact means; and a fixed resistance electrically connected in series between said contact means and said electrical connector means.

5. The throttle position sensor according to claim 4 wherein said resistance means comprises a first track having a first resistive layer disposed between two limits, and a first and a second conductive pad connected to said first resistive layer defining respectively the opposite ends of said track, said first and second conductive pads connected to said electrical connector means.

6. The throttle position sensor according to claim 5 additionally including a second track displaced from said first track, said second track having a conductive layer between said same two limits and includes a third conductive pad at one end thereof and said contact means electrically interconnecting said first resistive layer with said conductive layer at corresponding points along their respective track between said two limits.

7. The throttle position sensor according to claim 6 wherein said fixed resistance is integral with said second track, said fixed resistance interposed said third conductive pad and said conductive layer, and providing integral shorting protection between said third conductive pad and at least one of said first and second conductive pads through said contact means.

8. A throttle position sensor to indicate the angular rotation of the throttle blade in the throttle body of an internal combustion engine said sensor comprising:

a housing means;

rotatable means journalled in said housing means and connectable to the throttle blade for rotation therewith;

circuit means bonded to said housing means comprising:

a first track having a resistive layer between two limits on said track, said first track having first and second conductive terminal pads at each end of said resistive layer outwardly of said two limits;

a second track displaced from said first track, said track having a conductive layer and a third conductive terminal pad at one end of said conductive layer;

a fixed resistance means interposed between the third conductive terminal pad and said conductive layer; and contact means mounted within said housing means said contact means operatively connected to said rotatable means for rotation therewith, and having at least two contact wiper terminals contacting said first and second tracks between said two limits with the rotation of said rotatable means.

9. The throttle position sensor according to claim 8 further including terminal contact means attached to each of said conductive terminal pads and extending externally from said housing means.

10. A throttle position sensor adapted for the measurement of the rotative position of the throttle blade of a throttle for internal combustion engine, said sensor comprising:

a housing having a cover adapted to be secured to said housing in a sealing relationship;

a resistive element inside said housing having two spaced apart tracks, one track having a resistive layer extending between two limits on said track the other track having a conductive layer between said same two limits and each track having terminals at the respective ends of said tracks;

cylindrical rotor means mounted for rotation within the housing and operative to be rotatable coupled to the throttle blade;

contact means having a pair of spaced conductive wipers, said contact means mounted to said rotor means within said housing and operative to electrically bridge said two tracks; and a fixed resistance integral with the other of said tracks and interposed between said conductive layer and the terminal at the end thereof thereby providing a fixed resistance between the end of said other track and either end of said one track independent of the electrical position of said contact means.

11. The throttle position sensor according to claim 10 additionally including spring means mounted on said rotor means and operative to bias said rotor toward one extreme rotational position of the throttle blade.

* * * * *

REEXAMINATION CERTIFICATE (379th)

United States Patent [19] [11] B1 4,355,293

Driscoll [45] Certificate Issued Sep. 3, 1985

[54] ELECTRICAL RESISTANCE APPARATUS HAVING INTEGRAL SHORTING PROTECTION

[75] Inventor: Barry J. Driscoll, Newport News, Va.

[73] Assignee: The Bendix Corporation, Southfield, Mich.

Reexamination Request:
No. 90/000,570, Jun. 4, 1984

Reexamination Certificate for:

| | |
|---|---|
| Patent No.: | **4,355,293** |
| Issued: | **Oct. 19, 1982** |
| Appl. No.: | **281,804** |
| Filed: | **Jul. 9, 1981** |

Related U.S. Application Data

[63] Continuation of Ser. No. 86,911, Oct. 22, 1979, abandoned.

[51] Int. Cl.[3] ..... H01C 10/00

[52] U.S. Cl. ..... 338/184; 123/494; 338/162; 338/183; 338/211; 338/309; 338/325

[58] Field of Search ..... 338/125, 128, 142, 160, 338/162, 167, 170, 171, 174, 176, 183, 184, 188, 199, 262, 292, 307–309, 320, 314, 325, 327, 328, 330, 333, 334; 123/494

[56] References Cited

U.S. PATENT DOCUMENTS

| | | | |
|---|---|---|---|
| 1,885,633 | 11/1932 | Schellenger | 338/165 |
| 2,618,724 | 11/1952 | Vlahos | 201/48 |
| 2,657,295 | 10/1953 | Barclay | 201/48 |
| 3,045,200 | 7/1962 | Hines et al. | 338/174 |
| 3,061,807 | 10/1962 | Hollander et al. | 338/176 |
| 3,090,001 | 5/1963 | Van Horne | 323/79 |
| 3,164,798 | 1/1965 | Morgan | 338/174 |
| 3,373,396 | 3/1968 | Yungblut et al. | 338/183 |
| 3,380,011 | 4/1968 | Baskett | 338/162 |
| 3,457,537 | 7/1969 | Hines | 338/162 |
| 3,693,062 | 9/1972 | Von Vick | 338/92 |
| 3,784,948 | 1/1974 | Johnston et al. | 338/183 |
| 3,887,892 | 6/1975 | Rozema et al. | 338/183 |
| 4,012,710 | 3/1977 | Ward et al. | 338/128 |
| 4,021,768 | 5/1977 | Stuckey | 338/180 |
| 4,060,788 | 11/1977 | Numata et al. | 338/128 |
| 4,139,831 | 2/1979 | Ortlieb et al. | 338/128 |
| 4,213,112 | 7/1980 | Alman et al. | 338/183 |
| 4,280,465 | 7/1981 | Staerzl | 123/494 |
| 4,308,838 | 1/1982 | Nakano et al. | 123/494 |

*Primary Examiner*—C. L. Albritton

[57] ABSTRACT

An electrical resistance apparatus adapted for the measurement of the position of the throttle blade of an internal combustion engine is disclosed. The apparatus includes a generally annular housing which has an inside surface that supports a flexible resistive element. The resistive element comprises a flexible web on which two parallel resistive tracks have been overlaid. A generally cylindrical rotor mounts within the housing and electrically couples the two tracks by means of a U-shaped conductive wiper that bridges the separation between the resistive tracks. The rotor is mechanically connected to the throttle blade of the internal combustion engine and rotates therewith. By applying the leads of a power supply to one resistive track and reading a voltage signal from the other resistive track, a potentiometric signal related to the position of the throttle blade is developed. Integral with the resistive track developing the position signal is a protection resistor providing shorting protection in case of the misconnection of the power and signal terminals.

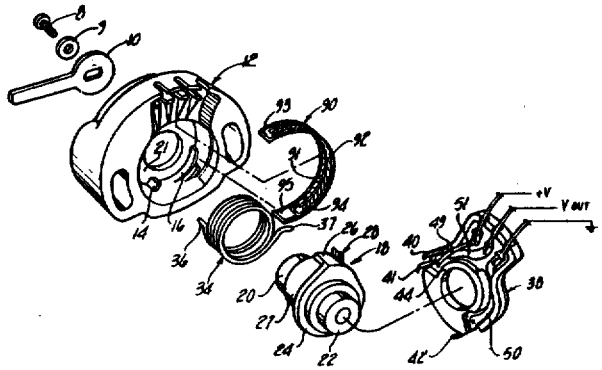

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 and 4–11 is confirmed.

Claim 2 is determined to be patentable as amended.

Claim 3, dependent on an amended claim, is determined to be patentable.

2. A flexible resistive element [as defined in claim 1 wherein] *adapted for connection as a potentiometer comprising:*

*a flexible web;*

*a first track overlaid on said web and forming a potentiometer resistor, said first track having a first resistive layer between two limits on said track, a first conductive terminal pad and a second conductive terminal pad each respectively electrically connected to said track outwardly of said two limits;*

*a second track overlaid on said web and forming a signal terminal, said second track displaced from and substantially parallel to said first resistive layer, said second track including a third conductive terminal pad at one end thereof outwardly of one of said limits;*

*resistive means integral with said second track and between said third conductive terminal and said one limit comprising a protection resistor thereby providing integral shorting protection between said third conductive terminal and at least one of said first and second conductive terminals,* and

[said] *a* second [track is overlaid with a ] resistive layer *overlying said second track and* integral with *said* resistive means.

* * * * *